US008522871B2

(12) United States Patent
Anderson et al.

(10) Patent No.: US 8,522,871 B2
(45) Date of Patent: Sep. 3, 2013

(54) METHOD OF DIRECT STEAM GENERATION USING AN OXYFUEL COMBUSTOR

(75) Inventors: Roger E. Anderson, Gold River, CA (US); Keith L. Pronske, Wilton, CA (US); Murray Propp, Calgary (CA)

(73) Assignee: Clean Energy Systems, Inc., Rancho Cordova, CA (US)

( * ) Notice: Subject to any disclaimer, the term of this patent is extended or adjusted under 35 U.S.C. 154(b) by 535 days.

(21) Appl. No.: 12/660,780

(22) Filed: Mar. 4, 2010

(65) Prior Publication Data

US 2010/0224363 A1 Sep. 9, 2010

Related U.S. Application Data

(60) Provisional application No. 61/209,322, filed on Mar. 4, 2009.

(51) Int. Cl.
*E21B 43/24* (2006.01)

(52) U.S. Cl.
USPC ..... 166/272.1; 166/303

(58) Field of Classification Search
USPC ..... 166/272.1, 302, 303
See application file for complete search history.

(56) References Cited

U.S. PATENT DOCUMENTS

| | | | | |
|---|---|---|---|---|
| 2,734,578 | A * | 2/1956 | Walter | 166/402 |
| 4,648,835 | A * | 3/1987 | Eisenhawer et al. | 431/4 |
| 4,861,263 | A * | 8/1989 | Schirmer | 431/158 |
| 4,930,454 | A * | 6/1990 | Latty et al. | 122/4 D |
| 7,780,152 | B2 * | 8/2010 | Rao | 261/79.1 |
| 8,091,625 | B2 * | 1/2012 | Ware et al. | 166/59 |
| 2002/0174659 | A1 * | 11/2002 | Viteri et al. | 60/780 |
| 2005/0241311 | A1 * | 11/2005 | Pronske et al. | 60/645 |
| 2007/0202452 | A1 * | 8/2007 | Rao | 431/354 |

* cited by examiner

*Primary Examiner* — Angela M DiTrani
*Assistant Examiner* — Catherine Loikith
(74) *Attorney, Agent, or Firm* — Heisler & Associates

(57) ABSTRACT

A gas generator is provided with a combustion chamber into which oxygen and a hydrogen containing fuel are directed for combustion therein. The gas generator also includes water inlets and an outlet for a steam and $CO_2$ mixture generated within the gas generator. The steam and $CO_2$ mixture can be used for various different processes, with some such processes resulting in recirculation of water from the processor back to the water inlets of the gas generator. In one process a hydrocarbon containing subterranean space is accessed by a well and the steam and $CO_2$ mixture is directed into the well to enhance removability of hydrocarbons within the subterranean space. Fluids are then removed from the subterranean space include hydrocarbons and water, with a portion of the hydrocarbons then removed in a separator/recovery step. The resulting hydrocarbon removal system can operate with no polluting emissions and with no water requirements.

6 Claims, 4 Drawing Sheets

METHOD OF DIRECT STEAM GENERATION USING AN OXYFUEL COMBUSTOR

CROSS-REFERENCE TO RELATED APPLICATIONS

This application claims benefit under Title 35, United States Code §119(e) of U.S. Provisional Application No. 61/209,322 filed on Mar. 4, 2009.

FIELD OF THE INVENTION

The following invention relates to methods and systems for generating steam directly as products of combustion of oxygen with a hydrogen containing fuel. More particularly, this invention relates to methods of direct steam generation and utilization which generate both steam and carbon dioxide as products of combustion of a hydrogen and carbon containing fuel with oxygen and methods and systems for utilization of the resulting steam and carbon dioxide mixture in processes such as hydrocarbon recovery.

BACKGROUND OF THE INVENTION

Steam has many uses. For instance, steam is used in food processing, industrial processing, refining processes and chemical processes. Furthermore, steam can be utilized for power generation. Steam is also used to enhance oil and other hydrocarbon recovery. For instance, steam is used for recovery of heavy oils that have become somewhat entrapped within other soils or other constituents in geological formations and to cause the heavy oils and/or bitumen or other hydrocarbons to be more readily extracted and handled.

Depending on the use to which the steam is to be put, varying degrees of steam purity are required. Furthermore, some processes may have a high tolerance of some types of impurities and a low tolerance for other types of impurities. For instance, any non-condensable gases within a steam working fluid can cause a condenser of a power plant to work improperly unless a condenser is properly configured to remove such non-condensable gases (i.e. carbon dioxide or air). In food processing, contaminates which might be harmful to the consumer of the food are to be avoided if the steam comes into direct contact with the food. While non-condensable gases (unless in high amounts) are generally not a problem with food processing uses for steam.

In the prior art, the most typical way to generate steam is to utilize a boiler. Most boilers are indirect in that they combust a fuel and heat walls of a heat exchanger with the hot products of combustion. Water flows on the other side of the heat exchanger wall (typically within pipes) with the water in the pipes boiling into steam as the water passes through the boiler. The water is thus indirectly heating into steam. When all of the water has been boiled into steam, and no additional heat has been added, the steam is considered to be "saturated." If the water has not been entirely boiled, but has some condensate water still therein, the steam is considered to be "wet." If more heat has been added past the boiling point for all of the water, and all of the steam has been elevated in temperature above the boiling point for water at the given pressure, the steam is considered to be "super heated." Depending on the temperature of steam required, and whether or not it is important that the steam be completely gaseous or benefits from being wet, the boiler is configured to raise the steam to the desired temperature and state. The steam can then be beneficially utilized.

More recently, a form of direct steam generation has been developed that is referred to as oxyfuel combustion. With oxyfuel combustion, a fuel containing hydrogen and/or carbon is combusted with oxygen (either pure oxygen or an oxidizer containing a greater proportion of oxygen than is present in air, i.e. about twenty percent). The hydrogen in the fuel reacts with the oxygen to directly form water. The temperature of such reactions is such that typically the water is formed in a gaseous state as super heated steam. Most typically with oxyfuel combustion, water (or some other diluent) is also added into a combustion chamber thereof to cool down the high temperature steam produced by combustion of the fuel with the oxygen. This additional water is directly heated into steam and is mixed with the steam generated by combustion of the fuel with the oxygen.

When the fuel also contains carbon, this carbon combines with the oxygen to also form carbon dioxide within the combustion chamber. Once the steam and carbon dioxide generated within the oxyfuel combustion gas generator are mixed with diluent cooling water, the stream exiting the gas generator is typically largely steam, with the carbon dioxide being a minority component. The degree of cooling required, the diluent flow rate, and the type of fuel influence these relative percentages of steam and carbon dioxide in the mixture exiting the gas generator.

Examples of such oxyfuel combustors and oxyfuel combustion systems are described in U.S. Pat. Nos. 5,680,764, 5,709,077 and 6,206,684, incorporated herein by reference in their entirety.

Steam and carbon dioxide can be relatively easily separated from each other, such as by providing a condenser cooling the mixture to the point where the water condenses into a liquid and the carbon dioxide remains a gas for effective separation of the carbon dioxide from the water. Also, many processes utilizing steam are tolerant to some amount of carbon dioxide along with the steam. Thus, direct steam generation through use of an oxyfuel combustion gas generator can be utilized for a variety of the processes which require steam. This invention is directed to variations on oxyfuel combustion gas generators and associated systems for effective utilization of direct steam generation oxyfuel combustion gas generators for the generation of steam for various uses in which steam is to be utilized.

SUMMARY OF THE INVENTION

The basic concept of this invention is to use a high pressure oxyfuel combustor (i.e. a "gas generator") operating at near stoichiometric conditions with water injection for direct generation of a high temperature, steam rich steam/$CO_2$ gas mixture. This concept provides an efficient, very compact means of producing such a fluid without the need for a conventional type boiler. The resulting steam/$CO_2$ mixture stream may be used for many different applications including power generation in a direct, indirect (using a heat recovery steam generator (HRSG)), simple or combined power cycles; chemical refining; industrial and food processing; and recovery of fossil fuels using the steam fraction, $CO_2$ fraction or the combined gas stream, such as in enhanced oil recovery (EOR) operations, enhanced natural gas recovery (EGR), enhanced coal bed methane (ECBM) recovery, steam assisted gravity drain (SAGD) hydrocarbon (typically heavy oils and/or bitumen recovery) or other such operations.

The fuel feed may vary widely in both chemical makeup and physical form but is preferably composed primarily of the elements hydrogen and carbon and may contain oxygen without a detrimental effect. Fuels that contain substantial amounts of elements that can form acidic oxides (e.g. nitrogen, sulfur and phosphorous), elements that form ash (aluminum, silicon, calcium, magnesium, iron, etc.), or heavy metals adversely affect the quality of the steam rich gas. Such fuels can, however, be used if the resulting contaminants of the steam/$CO_2$ stream are not detrimental to the downstream application or if post combustion cleanup processes are implemented.

The oxygen supply to the oxyfuel combustor is normally derived from air from which the nitrogen is largely separated by any of several well known processes (e.g. cryogenic distillation, pressure (or vacuum) swing adsorption or membranes). The purity of oxygen supply is generally dictated by the tolerance for nitrogen and argon in the steam/$CO_2$ product stream. Typically, the oxygen purity will be greater than 90% $O_2$ by volume.

The water injected into the oxyfuel combustor is preferably near boiler feedwater quality when the downstream steam/$CO_2$ product must be very low in solids content and/or a recycle condensate provides the major portion of the water supply. This case is most prevalent in applications involving direct drive power generation and chemical, refining, industrial or food processing applications. In other processes, such as in hydrocarbon recovery, the water quality does not significantly affect the process, so that water quality need only be sufficient to avoid hampering operation of the gas generator (e.g. plugging of water inlets, scaling, corrosion, etc.).

In some cases, the steam in the steam/$CO_2$ mixture may be partially consumed by the downstream process. This results in decreased production of recyclable condensate and excess water and may even require a continuous supply of makeup water. Similarly, the $CO_2$ may be partially consumed by the downstream process and result in a decrease in the amount of $CO_2$ leaving the system. The exiting $CO_2$ stream may be recovered and conditioned to make it suitable for commercial sale, enhanced possible fuel recovery (i.e. EOR, ECBM, etc.), or for sequestration, such as by storage in a saline aquifer or other subterranean geological storage location. If significant amounts of contaminants (elements other than carbon, hydrogen and oxygen) enter in any of the feed streams, the steam/$CO_2$ mixture from the combustor may require cleanup prior to downstream use or the recycle water and/or the $CO_2$ may require cleanup.

A second embodiment of the concept involves the use of brackish and/or oily water along with fuel and oxygen supplies as described previously. One of the preferred uses of the second concept is for the steam assisted gravity drain (SAGD) method of recovering bitumen or heavy oils. The brackish and/or oily water may come from any source but often results from the separation of the water fraction of the oil/bitumen obtained from the SAGD operation and upgrading of that water as deemed most appropriate (e.g. lime softening).

If the resulting saturated steam/$CO_2$ stream requires superheat, this can be accomplished using an isenthalpic throttling valve/device or an oxyfuel reheater. Although a preferred use of the steam/$CO_2$ stream shown in FIG. 2 is direct injection for SAGD operations, it may alternatively be directed to a heat recovery steam generator (HRSG) to raise high pressure steam for various purposes (e.g. power generation, recovery of heavy oil or chemical, refining, industrial and food processing) while also producing recyclable condensate and a $CO_2$ rich stream which can be recovered for commercial sale, use for enhanced oil recovery (EOR), enhanced coal bed methane (ECBM) recovery or for sequestration away from the atmosphere.

OBJECTS OF THE INVENTION

Accordingly, a primary object of the present invention is to provide a direct steam generator that eliminates the need for convention boilers to produce a high pressure, steam-rich gas.

Another object of the present invention is to provide a steam generator that has the ability to use a wide range of fuels varying in both chemical makeup and physical form but preferably composed primarily of the elements hydrogen and carbon.

Another object of the present invention is to provide a method for steam generation which produces exhaust gases rich in steam, which also contains combustion-derived carbon dioxide ($CO_2$) with the $CO_2$ optionally prevented from entering the atmosphere.

Another object of the present invention is to provide a method and system for removal of hydrocarbons from a hydrocarbon containing subterranean space which is enhanced by steam and $CO_2$ injection into the subterranean space.

Another object of the present invention is to provide a method and system for removal of hydrocarbons from a subterranean space involving injection of steam into the subterranean space, with the steam generated in a manner which includes little or no atmospheric emissions.

Another object of the present invention is to provide a method and system for removal of hydrocarbons from a subterranean hydrocarbon containing space which recycles oily waste water by combusting oil within the oily waste water and in a manner which has low or zero atmospheric emissions.

Another object of the present invention is to provide steam and carbon dioxide for a steam assisted gravity drain (SAGD) operation in a manner which has low or zero atmospheric emissions and which can operate on a variety of different available fuels including at least partially hydrocarbons removed from the SAGD operation itself.

Another object of the present invention is to provide a method and process for direct steam generation that can take "dirty" water that is brackish, oily or otherwise contaminated and input it into a high temperature oxyfuel combustion gas generator to produce high temperature steam at least partially from the "dirty" water, such that a source of relatively pure water is not required for steam generation.

Other further objects of the present invention will become apparent from a careful reading of the included drawing figures, the claims and detailed description of the invention.

DESCRIPTION OF THE PREFERRED EMBODIMENT

Figure 1:
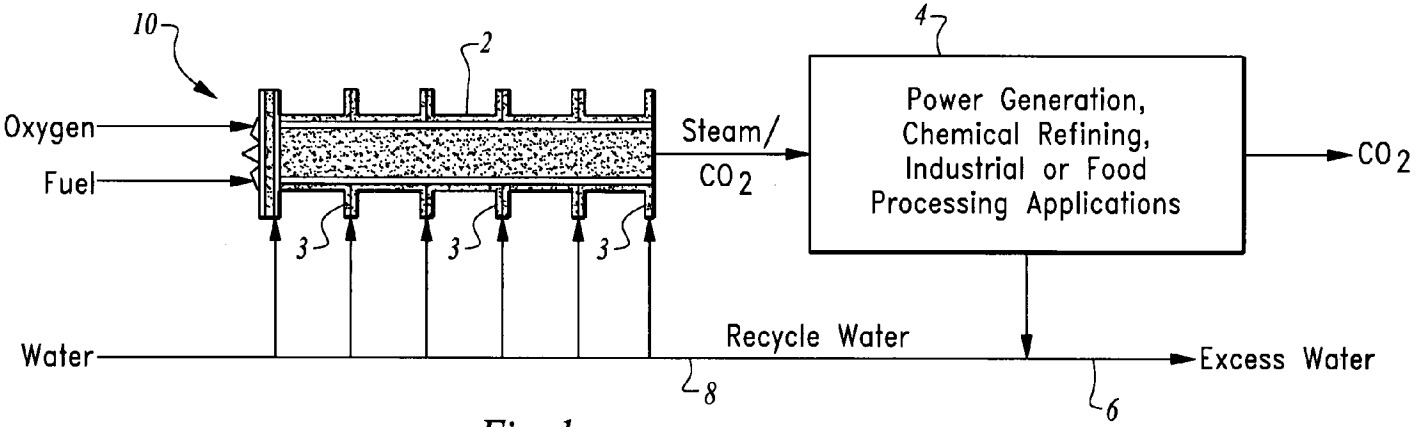
FIG. 1 is a schematic of a simple closed cycle including steam and $CO_2$ generation within a gas generator and feeding the steam and $CO_2$ to a processor and recirculation of some of the water from the processor back to the gas generator.

Referring to the drawings, wherein like reference numerals represent like parts throughout the various drawing figures, reference numerals 10, 110, 210 and 310 are directed to various systems and processes illustrative of embodiments of this invention. The systems 10, 110, 210, 310 each include a gas generator 2, 12 which is configured to combust an oxygen rich oxidizer with a hydrogen containing fuel, and with water inlets, resulting in the output of a high temperature steam and carbon dioxide mixture (or conceivably only steam if the fuel is carbon free). This steam and $CO_2$ mixture can then be used for a variety of different processes (FIG. 1). If the water is "dirty" such as being brackish, a salt separator, such as a cyclone type separator 14 (FIGS. 2 and 3) can be utilized for separation of such contaminants before utilization of the steam/$CO_2$ mixture. In the case of the water being oily, hydrocarbons within the water can potentially be combusted within the gas generator 12 along with the fuel and oxygen. The process can be closed cycle with recirculation of water from the steam/$CO_2$ mixture back to the gas generator 12, or open without such recirculation.

In particular embodiments of the system 210, 310 the steam and $CO_2$ mixture is routed into a well 30 of a subterranean hydrocarbon containing space 40, such as a steam assisted gravity drain (SAGD) operation. The steam and $CO_2$ interact with hydrocarbons in the subterranean space 40 to assist in removal of a mixture of hydrocarbons and water from the subterranean space 40. Hydrocarbons (e.g. oil and/or bitumen) can then be recovered 60 from this output 50 from the subterranean space 40. Water from this removal process can optionally be recycled back to the gas generator 12, such that the system 210, 310 can operate substantially without emissions, either into the atmosphere or in the form of waste water or other surface discharge.

Many details of the gas generator 2, 12 of the various embodiments of this invention are described in the prior art, and as incorporated herein by reference hereinabove. Oxygen for the gas generator 2, 12 (FIGS. 1-3 and 5) can be provided from a variety of different sources, but is most preferably supplied from an air separation unit (ASU) 100. Such an air separation unit separates oxygen from the air, such as by liquefaction or pressure/vacuum swing adsorption, or other air separation technologies. The oxygen could also be supplied from liquid oxygen storage tanks or oxygen pipelines. While the oxygen is preferably substantially pure, systems according to this invention could beneficially operate with sources of oxidizer which are merely oxygen rich, having a greater proportion of oxygen than that present in air (i.e. twenty percent).

The fuels utilized by the gas generators 2, 12 of the various embodiments of this invention could be either gaseous or liquid fuels. Some of the preferred gaseous fuels include hydrogen, natural gas, digester gases, landfill gases, refinery waste gases and syngas, such as that derived from gasification of coal or petcoke. Some of the preferred liquid fuels include unadulterated hydrocarbons, alcohols and glycerin or their solutions, emulsions or gels in a carrier such as water. Preferred solid fuels include small particle, high carbon fuels such as petcoke or heavy residuum or biomass (plant or algal) suspended in a fluid carrier.

While the fuel inlet is shown at an injection end of the gas generator 2, 12, particularly in the case of liquid fuels, the fuels could be introduced at downstream sections of the gas generator 2, 12 spaced from the injection end of the gas generator 2, 12.

The gas generator 2, 12 preferably has an injection head where oxygen and fuel are primarily introduced through inlets into the gas generator 2, 12. A series of separate sections are provided downstream from the injection head of the gas generator 2, 12. Each of these sections preferably includes water or other diluent inlets 3, 13 between these sections. With water or other diluent introduced into the gas generator 2, 12 in these sections, each section exhibits a progressively lower temperature. In such a configuration, reaction time within the gas generator 2, 12 can be controlled to some extent and enhance the degree to which combustion reactions are driven to completion before being quenched by cooling associated with introduction of the water or other diluent into the gas generator 2, 12.

These water inlets 3, 13 primarily introduce water for cooling of the steam and carbon dioxide mixture produced by combustion of the fuel and oxidizer within the gas generator 2, 12. Optionally, especially early water inlets close to the injection head can also introduce water with fuel, or at least oily residuum from a oil/bitumen recovery process 60 (FIGS. 3 and 5) for combustion of such hydrocarbons within the gas generator 12 in high temperature sections thereof. While five sections are shown in the figures (FIGS. 1-3 and 5) a greater or lesser number of such sections could optionally be provided.

Particularly oily water is fed only to the highest temperature zones (also called sections) of the gas generator 2, 12 (first and possibly second zones) whereas brackish water can be fed to all the zones. In general, the product from the combustor is a mixture of wet steam and $CO_2$. The quality of the steam is such that the liquid water fraction is sufficient to keep salts in solution. If the salt content of the product stream is high enough to cause problems (e.g. corrosion or plugging) with direct injection, the wet steam/$CO_2$ mixture can be separated into a saturated steam/$CO_2$ fraction and a brine fraction by a de-entrainment 14 device such as a cyclone or dropout vessel.

With particular reference to FIG. 1, details of a closed cycle simple process according to an embodiment of this invention are described. In this system 10, the gas generator 2 is fed with fuel and oxygen, as well as water through water inlets 3. A steam and $CO_2$ mixture is provided to a processor 4. This processor 4 can be in the form of power generation i.e. through a heat recovery steam generator (HRSG) or by directly driving a turbine, or could provide chemical refining, industrial process implementation or food processing applications.

As depicted herein, the steam and $CO_2$ mixture is utilized in a way which results in temperature decrease to the point where $CO_2$ remains gaseous and steam condenses into water. Separate $CO_2$ and water outlets are provided. This $CO_2$ could be captured for other industrial use or for sequestration away from the atmosphere, or merely released to the atmosphere. Water condensing as part of the process 4 or in a condenser downstream from the processor 4 is typically a greater amount of water than is required as diluent within the gas generator 2. Hence, some excess water 6 is removed from the system 10. Remaining recycle water 8 is returned back to the water inlets 3 for recirculation within the overall process 10.

Figure 2:
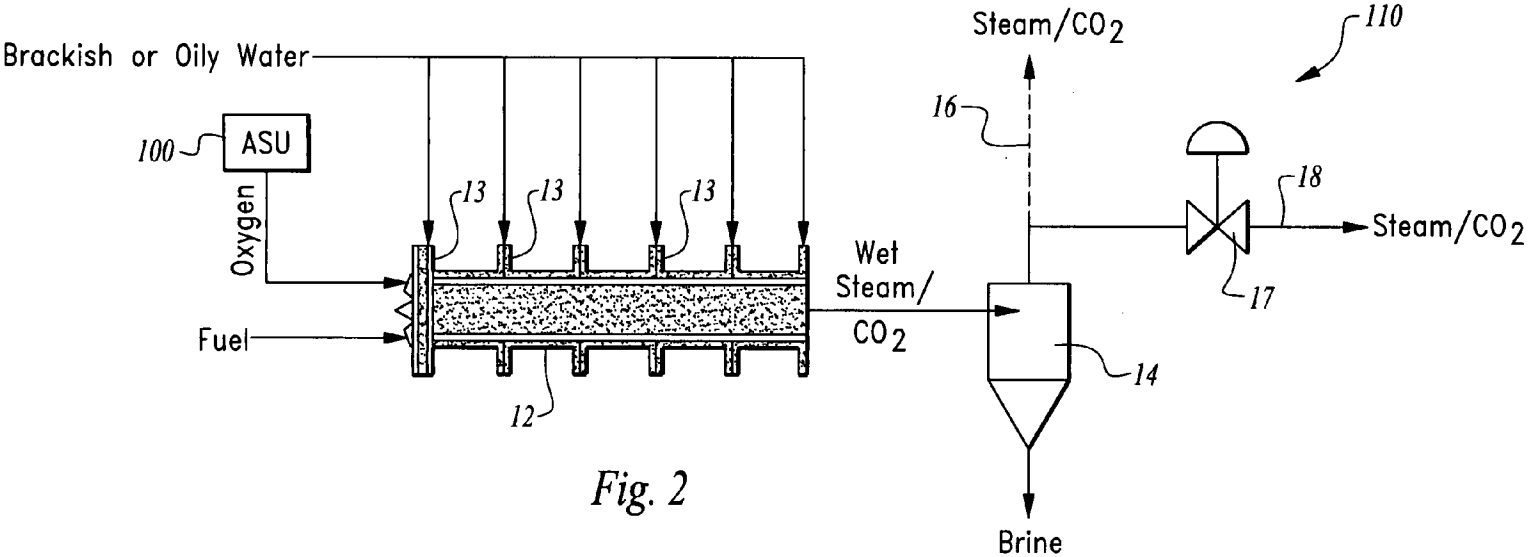
FIG. 2 is a schematic of a modified system of that which is shown in FIG. 1 which has been modified to be potentially an open cycle or a closed cycle, and with cooling water provided in the form of brackish or oily water and with associated salt separation equipment to accommodate salts within the cooling water, as well as a throttling valve for conditioning of the steam and $CO_2$ mixture (e.g. to enhance superheat of the water) before utilization.

With particular reference to FIG. 2, a system 110 is described which is a variation on the system 10 of FIG. 1. In the system 110, the water can optionally be "dirty" water such as being either brackish water, oily water, or water that otherwise includes various contaminants therein. Also, the system 110 of FIG. 2 is particularly shown as an open, rather than a closed cycle (although it could readily be closed by rerouting of steam discharged from the system 110 back to the water supply of the gas generator 12).

With the system 110, the gas generator 12 is configured similar to the gas generator 2 of system 10. Uniquely, dirty water inlets 13 are provided for introduction of dirty water into the gas generator 12. Should the water be brackish, salts within the water would typically remain in solution due to the high temperatures generated within the gas generator 12. If the contaminants within the water are susceptible to scaling walls of the gas generator 12 at the high temperatures involved within the gas generator 12, a softener can be provided upstream of the water inlets 13 to condition the water discourage such scaling from occurring. Similarly, if the "dirty" water has a pH which would tend to cause detrimental corrosion within the gas generator 12, the water can be appropriately conditioned, such as by adjusting pH thereof before entering the gas generator 12. Furthermore, appropriate filtration can be utilized to remove particulates of a size sufficiently large to plug portions of the water inlets 13 or which might be detrimental to downstream processes utilizing the steam and $CO_2$ mixture generated from the gas generator 12.

In the case of brackish water, or conceivably even high salinity water sources, such as sea water, salts within the water would typically remain and enter the gas generator 12 through the water inlets 13. Downstream of the gas generator 12, a separator 14 is provided for removal of brine and to allow lower salinity water to be discharged through a high pressure outlet 16 through utilization within an appropriate process.

Figure 4:
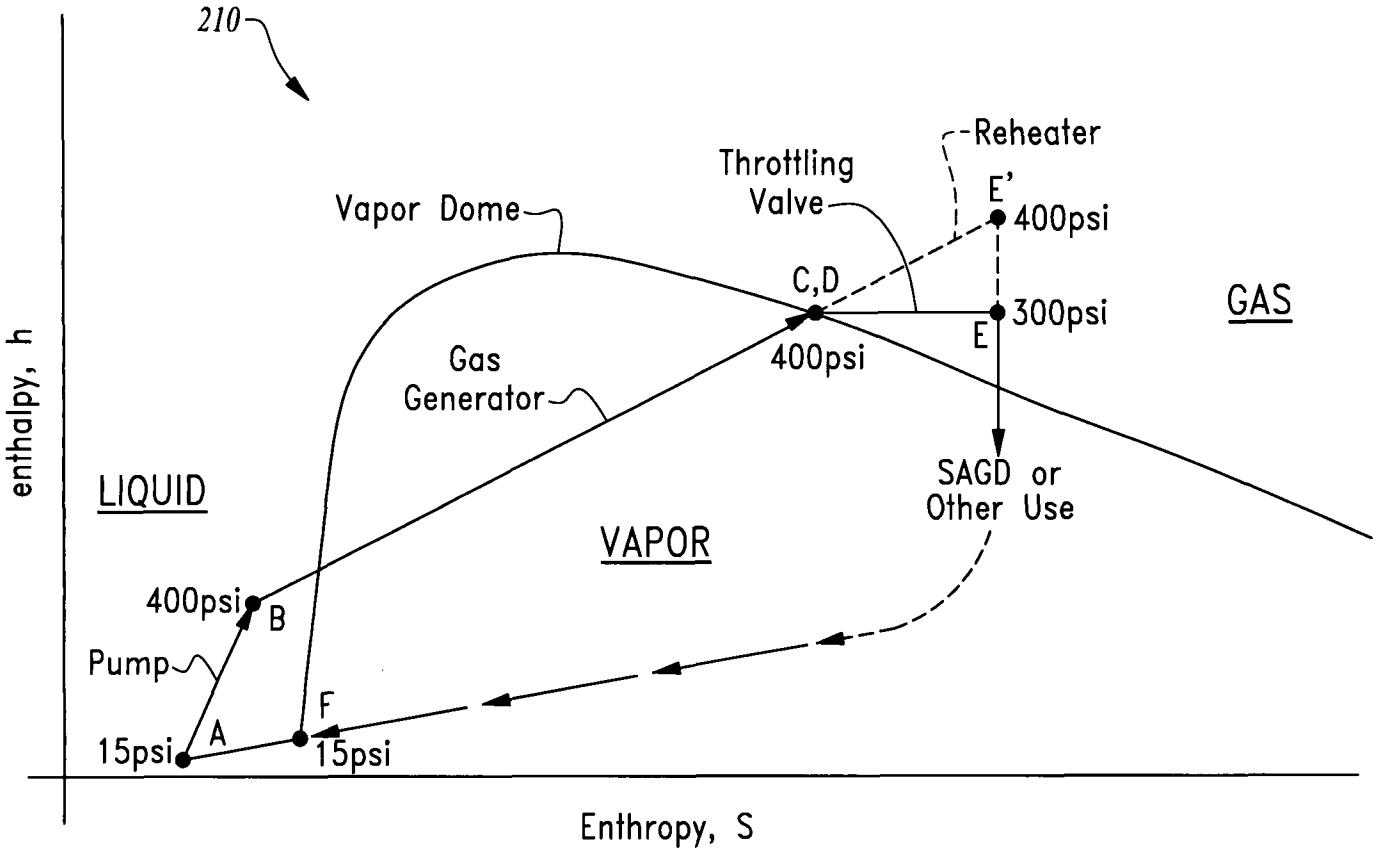
FIG. 4 is a graph of enthalpy vs. entropy for the water within the system of FIG. 3 with letters on the graph of FIG. 4 corresponding with points on the schematic of FIG. 3 and providing enthalpy and entropy information (as well as some pressure information) for the water within the system at various stages within the system, and relative to the water vapor dome.

If it is desired that this steam and $CO_2$ mixture have a lower pressure and/or a greater amount of superheat, the steam and $CO_2$ mixture can be routed through a throttling device 17, such as a valve configured to drop the pressure an appropriate amount and increase an amount of superheat (see FIG. 4, line segment DE). The resulting lower pressure outlet 18 can then be supplied to an appropriate process for further utilization of the steam and $CO_2$ mixture. Conceivably after utilization within this process, the steam and/or steam and $CO_2$ mixture can be recycled back to the water inlets 13, such that the overall system can be a closed system with little or not discharge of waste water from the system.

Figure 3:
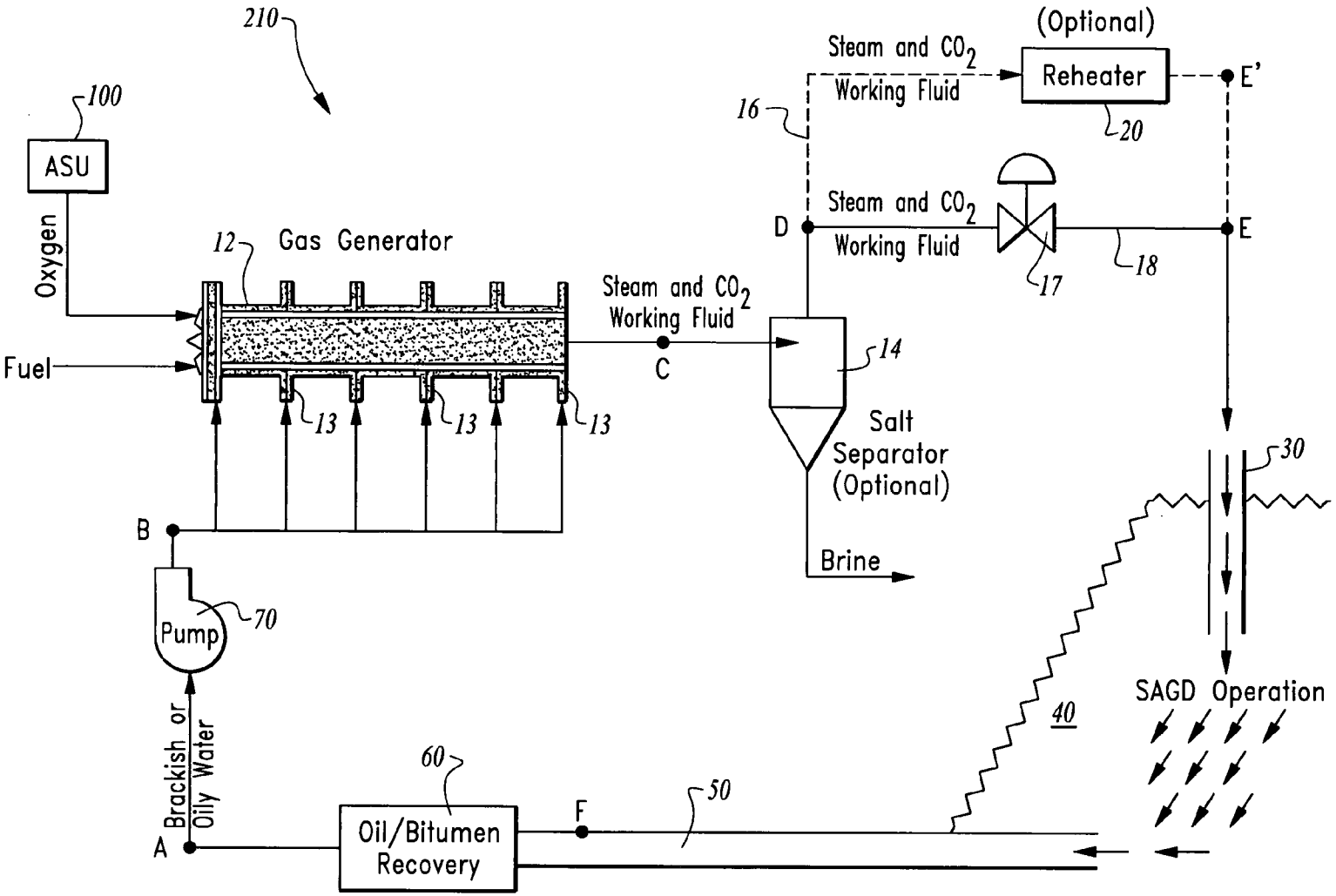
FIG. 3 is a schematic of a hydrocarbon recovery system and process utilizing a gas generator for direct steam and carbon dioxide generation, the system and process configured to recirculate water from the SAGD or other enhanced oil/hydrocarbon recovery operation back to the gas generator, to provide a closed loop hydrocarbon recovery system with no waste water and potentially zero atmospheric emissions.

With further discussion associated with FIGS. 3 and 4, details of a complete cycle are disclosed for a steam assisted gravity drain (SAGD) operation utilizing steam generated in a direct fashion utilizing the oxyfuel combustion gas generator 12, or analogous hydrocarbon recovery systems for other processes utilizing steam. In FIGS. 3 and 4 a SAGD operation is shown where an input well 30 is provided above an oil or bitumen containing subterranean geological structure 40. A drain 50 or other outlet (e.g. a pump-fitted recovery well) is provided at a lower portion of the geological structure 40 for drainage of a combination of oil and water condensed from the steam injected into the geological structure 40. This water has oil and/or bitumen entrained therein. As part of known SAGD operation procedures, the oil and/or bitumen is then recovered from the water in a recovery plant 60.

While such known SAGD operations have utilized steam, this steam has heretofore been generated utilizing traditional boilers as indirect steam generators. These boilers require a high quality source of water for effective operation, and also are relatively large for the amount of steam to be generated, and difficult to operate in areas where SAGD operation are to occur.

With this invention, utilizing direct steam generation, an oxyfuel combustion gas generator 12 is provided. The gas generator 12 is coupled to a source of oxygen, such as the ASU 100, which is preferably substantially pure oxygen, but can effectively operate with less than pure oxygen. A source of fuel containing hydrogen and/or carbon, and most typically a combination of both hydrogen and carbon is inputted from a source of fuel into the gas generator 12. The oxygen and fuel combust together within the gas generator 12 to develop a high temperature drive gas, typically including carbon dioxide and steam. To cool down this steam and carbon dioxide mixture, water is inputted into the gas generator 12 through the water inlets 13.

In this particular embodiment of FIG. 3, the water remaining from the oil and/or bitumen recovery station 60 typically still includes oil therein. This "oily water" can be inputted directly into the gas generator 12 to "close the cycle" at least partially. If the water has a large amount of oil therein, it is desirable to input the oily water as early as possible within the combustion reaction occurring within the gas generator 12, such that the oil has an opportunity to combust within the gas generator 12, and for such a combustion reaction to be driven to substantial completion before discharge from the gas generator 12.

The gas generator 12 would also typically have some tolerance for brackishness in the water or other contaminates, in that the high temperatures present within the gas generator 12 tend to keep salts from precipitating therein. If contaminants exist within the diluent water inserted into the gas generator 12, it is desirable for the gas generator 12 to discharge the working fluid as substantially saturated steam. In this way, any solids within the diluent can be precipitated most effectively. In this particular example, the gas generator 12 cools down the working fluid to the point where it is saturated steam (point C on FIGS. 3 and 4). A salt separator 14 can then optionally be utilized which is optimized to operate with saturated steam. Thereafter, it is typically desirable to superheat the steam somewhat. Such superheating can occur by dropping pressure through an isenthalpic throttling device 17 (point E on FIGS. 3 and 4). As another alternative, a reheater 20 can be provided to add additional heat to the steam (as well as carbon dioxide or other constituents) to maintain the pressure of the steam and add further heat to the steam (point E' of FIGS. 3 and 4).

Next, the superheated steam (and also typically carbon dioxide) is injected into the injection well 30 of the SAGD operation. It is typically desirable that the steam be sufficiently superheated that it will not be condensing within the well head where corrosion might be more likely to occur. Rather, it is desirable that the working fluid including primarily steam remain gaseous while passing through the well head 30 and any casing of the well, and only begin to condense once within the geological formation 40; depending on the particular characteristics of the geological formation 40 and the desires of the operator regarding the temperature and quality of the steam to be injected into the geological formation 40.

The oil and/or bitumen laden water is then drained (such as through the output 50) from the geological formation 40, typically at atmospheric pressure. Oil and/or bitumen can then be recovered (at the recovery plant 60) from the water draining from the geological formation 40. The largely cleaned water can then be routed through a pump 70 back to the gas generator 12 to repeat the cycle of the system 210.

While FIGS. 3 and 4 depict a system where steam is utilized for a SAGD operation, other processes utilizing steam could be interposed between points E and A in FIGS. 3 and 4 which utilize steam for any purpose. Note that the combustion of the fuel with the oxygen generates some new steam. Thus, even if some amounts of steam are consumed within the process, the generation of additional steam minimizes the requirement of additional makeup water for operation of such systems. Furthermore, such makeup water can often be less than pure water, and still function properly with any impurities either feeding a portion of a combustion reaction from the gas generator 12 or being separated either before or after passing through the gas generator 12.

Figure 5:
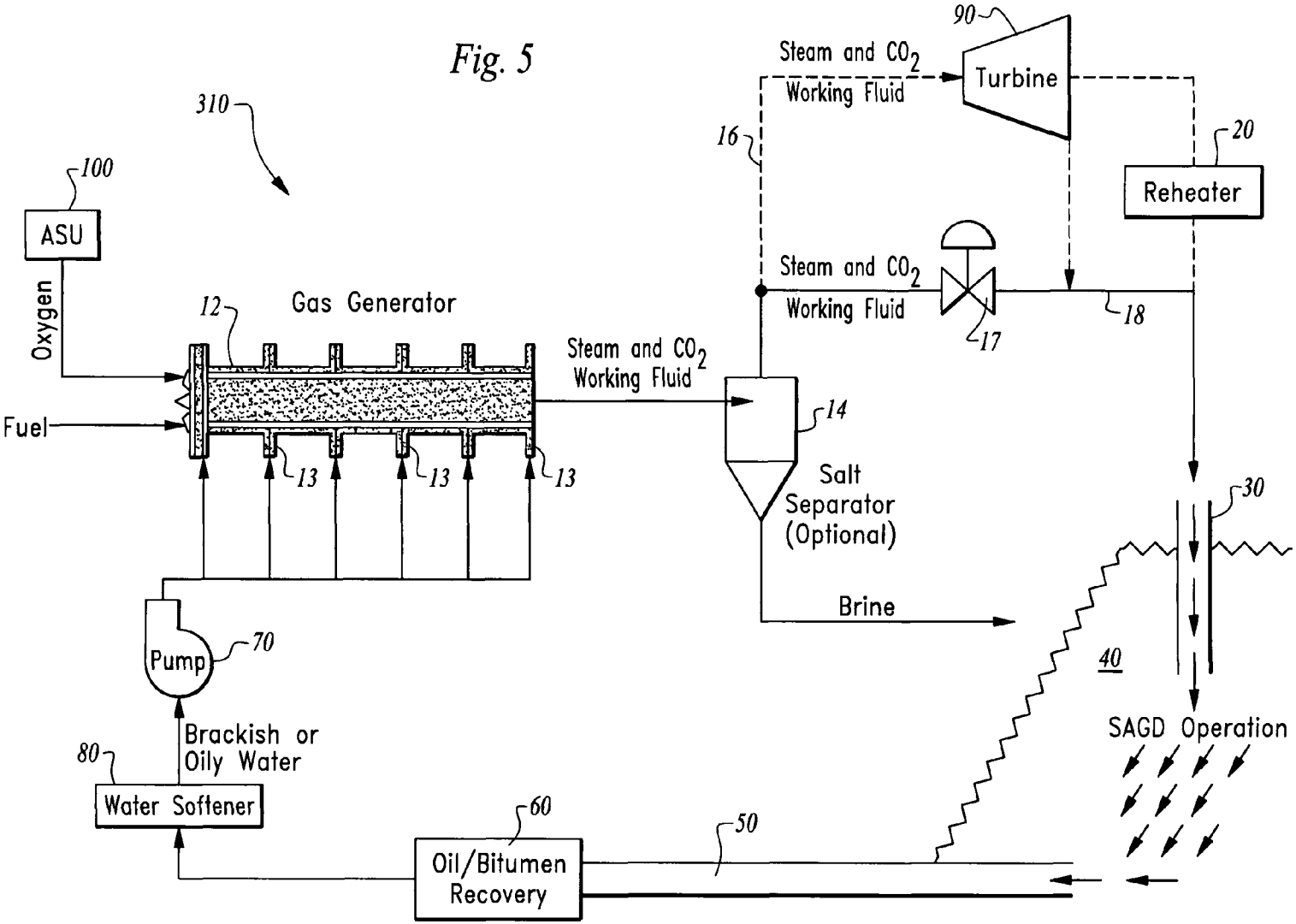
FIG. 5 is a schematic of a hydrocarbon recovery system similar to that which is shown in FIG. 3, but further including an optional power generation turbine and optional water softener for softening of recovered water before recirculation to the gas generator.

With particular reference to FIG. 5, details of an alternative embodiment system 310 are described. The system 310 is similar to the system 210 of FIG. 3, with a few refinements. First, a water softener 80 is optionally supplied upstream of the water inlets 13 of the gas generator 12. This water softener 80 is provided to appropriately condition the water should the water be of a character which would detrimentally affect the gas generator 12 or detrimentally affect downstream processes for which the steam and $CO_2$ working fluid generated by the gas generator 12 is to be utilized.

Such conditioning could include adding appropriate salts to minimize the potential for scaling within the gas generator 12 or downstream equipment, as well as the pump 70 upstream of the gas generator 12, and can also include neutralization equipment for pH adjustment to minimize corrosion within the gas generator 12, the pump 70 or downstream equipment, filtration systems to minimize particulates that would potentially otherwise be harmful for the gas generator 12, pump 70 or other downstream equipment, and other water conditioning.

Also, the system 310 is optionally provided with a turbine 90 which can be provided either upstream of the reheater 20 or downstream of the reheater 20. When the turbine 90 is upstream of the reheater 20, the gas generator 12 would typically be configured to discharge steam and $CO_2$ with some degree of superheat therein. If the steam and $CO_2$ is saturated upon discharge from the gas generator 12, the turbine 90 would typically be located downstream of the reheater 20. The turbine 90 could output additional power, either in the form of shaft power to drive equipment directly, or coupled to an electric generator to output electric power from the system 310. The turbine 90 and reheater 20 are in a line separate from the valve 17 or other throttling device. Steam and carbon dioxide flow can be directed either entirely through the throttling device 17 or entirely through the reheater 20, or some balancing can occur where split streams are provided.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted. When elements are described as upstream or downstream relative to other elements, such positioning can be with flow conduits therebetween and/or with other elements therebetween, or can be directly adjacent each other.

What is claimed is:

1. A method for direct steam and $CO_2$ mixed gas generation and utilization, including the steps of:

providing a gas generator having a combustion chamber, an oxygen inlet leading into the combustion chamber, a fuel inlet leading into the combustion chamber, a plurality of water inlets leading into the gas generator and a steam and $CO_2$ mixture outlet from the combustion chamber;

configuring the gas generator to include multiple adjacent chambers with separate water inlets passing into the gas generator between the adjacent chambers, such that temperatures in the adjacent chambers are progressively lower as distance from the combustion chamber increases;

coupling the steam and $CO_2$ mixture outlet of the gas generator to an inlet of a steam and $CO_2$ utilizing processor;

configuring the processor to be in the form of a steam assisted gravity drain site including a hydrocarbon containing subterranean space and a well extending into the subterranean space, the well coupled to the steam and $CO_2$ mixture outlet of the gas generator;

recirculating at least a portion of water and hydrocarbons exiting from a drain of the steam assisted gravity drain site to the water inlets of the gas generator; and combusting at least a portion of the hydrocarbons contained within the water within the gas generator.

2. The method of claim 1 wherein said recirculating step includes interposing a softener upstream of the at least one water inlet of the gas generator to soften the water before entry into the gas generator.

3. The method of claim 1 including the further step of recirculating water to the gas generator water inlets from a discharge of the processor, such that the method is at least partially a closed loop process.

4. The method of claim 1 including the further step of configuring the processor to include a separate water discharge and carbon dioxide discharge, the water discharge coupled to said gas generator water inlets for recirculating of water to the gas generator water inlet.

5. The system of claim 1 including the further step of locating a separator between the steam and $CO_2$ mixture outlet of the gas generator and the processor, the separator adapted to separate non-steam and $CO_2$ constituents from the steam and $CO_2$ mixture.

6. The method of claim 1 including the further step of recirculating at least a portion of water exiting from a drain of the steam assisted gravity drain site to the water inlets of the gas generator.

* * * * *